US009410350B2

(12) United States Patent
Stendal

(10) Patent No.: US 9,410,350 B2
(45) Date of Patent: Aug. 9, 2016

(54) LOCKING DEVICE WITH STRIKING ARRANGEMENT AND AUTOMATIC LOCKING

(75) Inventor: Jan Stendal, Västerås (SE)

(73) Assignee: Stendals El AB, Västerås (SE)

( * ) Notice: Subject to any disclaimer, the term of this patent is extended or adjusted under 35 U.S.C. 154(b) by 184 days.

(21) Appl. No.: 13/808,187

(22) PCT Filed: Jun. 27, 2011

(86) PCT No.: PCT/SE2011/050844
§ 371 (c)(1), (2), (4) Date: Jan. 3, 2013

(87) PCT Pub. No.: WO2012/005662
PCT Pub. Date: Jan. 12, 2012

(65) Prior Publication Data
US 2013/0106119 A1 May 2, 2013

(30) Foreign Application Priority Data
Jul. 5, 2010 (SE) ..... 1050735

(51) Int. Cl.

| | |
|---|---|
| ***E05C 5/00*** | (2006.01) |
| ***E05C 19/12*** | (2006.01) |
| ***E05B 15/10*** | (2006.01) |
| ***E05B 47/06*** | (2006.01) |
| ***E05B 63/00*** | (2006.01) |

(Continued)

(52) U.S. Cl.
CPC ..... *E05C 19/12* (2013.01); *E05B 15/101* (2013.01); *E05B 47/06* (2013.01); *E05B 63/0013* (2013.01); *E05B 63/20* (2013.01); *E05B 65/0811* (2013.01); *E05C 5/02* (2013.01); *Y10T 292/0917* (2015.04)

(58) Field of Classification Search
CPC ..... E05C 5/02; E05C 19/12; E05C 19/14; Y10T 292/0917; E05B 65/0811; E05B 63/22; E05B 63/0013
USPC ..... 292/4, 7, 57, 71, 63, 163, 177, 219, 292/229, 113, 340, 34, 144, 195.201, 292/DIG. 46; 70/107–111, 150, 151 R, 151 A
See application file for complete search history.

(56) References Cited

U.S. PATENT DOCUMENTS 181,115 A * 8/1876 Taylor ..... E05B 65/0811 70/110
479,104 A * 7/1892 Fleischel ..... E05B 65/0811 292/27

(Continued)

FOREIGN PATENT DOCUMENTS

| | | | |
|---|---|---|---|
| DE | 102004013297 | A1 | 9/2005 |
| FR | 2620482 | A1 | 3/1989 |
| GB | 191316620 | A | 0/1914 |

*Primary Examiner* — Kristina Fulton
*Assistant Examiner* — Faria Ahmad
(74) *Attorney, Agent, or Firm* — Dilworth & Barrese, LLP

(57) ABSTRACT

The present invention relates to a locking device suitable for allowing or restricting access into an area or space, the locking device (1) comprising at least one locking element (9) arranged to, in a first locking state, engage a striking arrangement (11), such as a strike plate, for holding a closing element (3), such as a door, locked, and, in a second, non-locking state, to allow movement of the closing element.

16 Claims, 3 Drawing Sheets

Figure 1A:
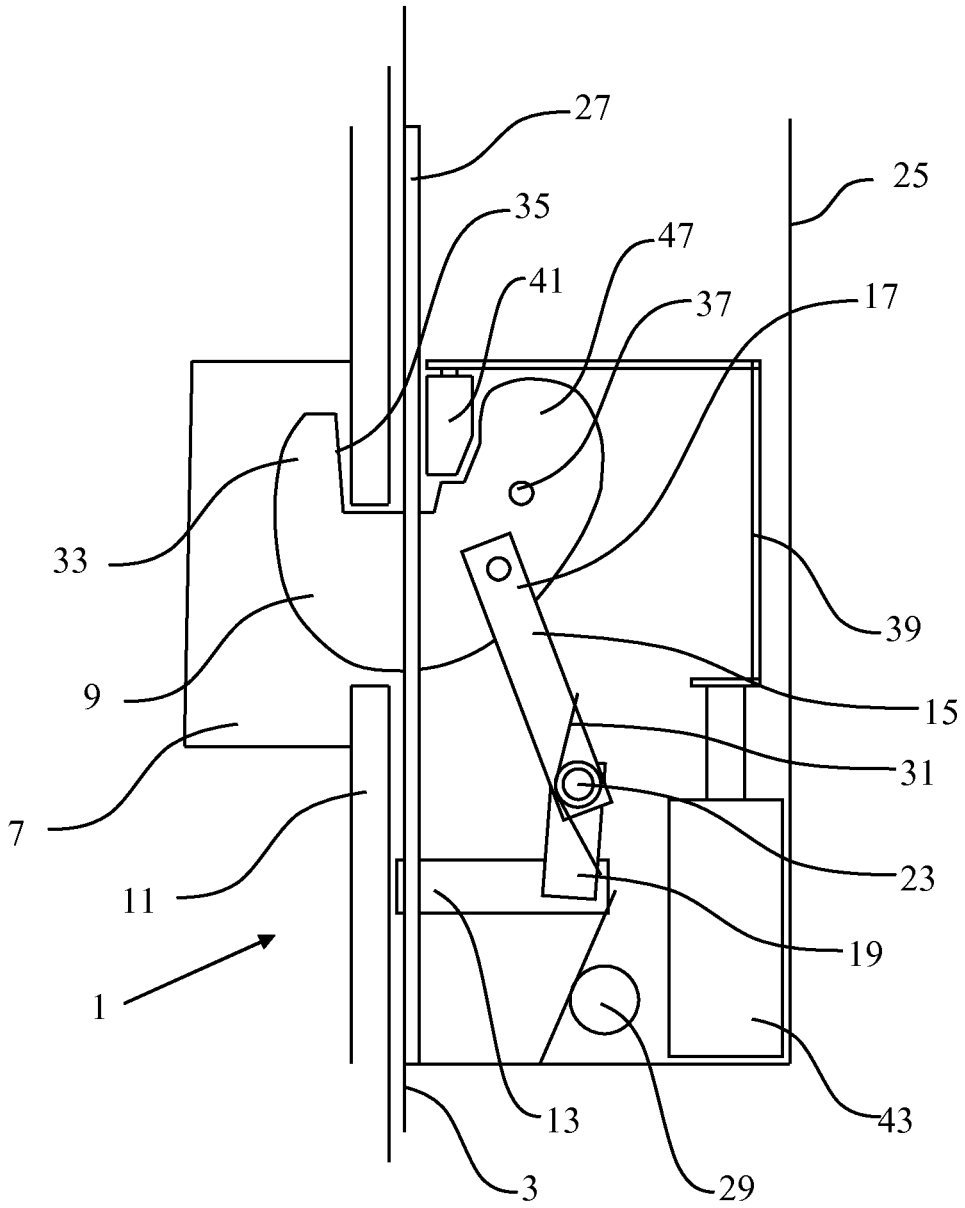

(51) Int. Cl.

| | |
|---|---|
| ***E05B 63/20*** | (2006.01) |
| ***E05B 65/08*** | (2006.01) |
| ***E05C 5/02*** | (2006.01) |
| *E05C 3/06* | (2006.01) |
| *E05B 15/02* | (2006.01) |
| *E05B 59/00* | (2006.01) |
| *E05B 63/14* | (2006.01) |
| *E05B 55/00* | (2006.01) |

(56) References Cited

U.S. PATENT DOCUMENTS 563,867 A * 7/1896 Moser ..... E05B 55/12 33/540
698,812 A * 4/1902 Carleton ..... E05B 47/0004 70/151 R
1,038,624 A * 9/1912 Messick ..... E05B 65/0852 292/201
1,195,713 A * 8/1916 Page ..... E05B 55/00 70/151 R
1,203,394 A * 10/1916 Ottinger ..... E05C 7/06 292/165
1,244,443 A * 10/1917 Hurd ..... E05B 65/1006 292/2
2,275,089 A * 3/1942 Pirtz ..... E05B 65/0811 292/106
2,668,319 A * 2/1954 Keys ..... E05B 65/0811 292/101
2,924,475 A * 2/1960 Russell ..... E05B 65/0817 292/113
2,980,458 A * 4/1961 Russell ..... E05B 65/0817 292/113
3,019,043 A * 1/1962 Woodworth ..... E05B 65/0817 292/113
3,337,250 A * 8/1967 Russell ..... E05B 57/00 292/210
3,390,908 A * 7/1968 Schlage ..... E05B 63/0013 292/195
3,495,424 A * 2/1970 Kleinschmidt ..... E05B 55/00 70/151 R
3,988,859 A * 11/1976 Peterson ..... E05B 51/02 292/201
4,237,711 A * 12/1980 Kambic ..... E05B 47/0002 292/223
4,429,556 A * 2/1984 Kambic ..... E05B 47/0692 70/149
4,434,635 A 3/1984 Borgato
4,523,186 A * 6/1985 Fiarman ..... 340/555
4,529,234 A * 7/1985 Senften ..... E05B 47/0046 292/150
4,677,834 A * 7/1987 Hicks ..... E05B 47/002 292/144
4,685,709 A * 8/1987 Kambic ..... E05B 47/0012 292/201
4,776,619 A 10/1988 Daugherty et al.
4,881,766 A * 11/1989 Schmidt ..... E05B 17/2026 292/201
4,902,053 A * 2/1990 Hakkarainen ..... E05B 47/002 292/144
5,083,448 A * 1/1992 Karkkainen ..... E05B 47/0012 292/144
5,566,991 A * 10/1996 Young ..... E05B 47/0012 292/201
5,595,409 A * 1/1997 Fier et al. ..... 292/112
7,866,713 B2 * 1/2011 Chen ..... E05B 13/004 292/165
2006/0123859 A1 * 6/2006 Gonzalez ..... E05B 59/00 70/107
2007/0051143 A1 * 3/2007 Raatikainen ..... E05B 47/0688 70/107
2007/0137267 A1 * 6/2007 Pilatowicz ..... E05B 47/068 70/107
2007/0200370 A1 8/2007 Reithmeyer
2008/0011029 A1 * 1/2008 Chen ..... E05B 13/004 70/107
2008/0087055 A1 * 4/2008 Chen ..... E05B 13/004 70/107
2010/0263418 A1 * 10/2010 Moon ..... E05B 55/00 70/107

* cited by examiner

LOCKING DEVICE WITH STRIKING ARRANGEMENT AND AUTOMATIC LOCKING

TECHNICAL FIELD

The present invention relates to a locking device suitable for allowing or restricting access into an area or space.

PRIOR ART

Locking devices for restricting access into an area or space are known in the art. Locking devices usually comprises one or more locking elements, such as a bolt, a bar or similar, for denying the opening of a closing element barring an opening into the area, such as a door, lid, window, hatch or similar. The position of the locking element is controlled by actuation of a lock requiring a key, key code, key signal or similar to be operated. Generally, the locking element is arranged to engage a striking arrangement, such as a strike plate, provided in for example a jamb or in another closing element for holding the closing element locked and immovable.

One example of a closing element is a sliding door which opens and closes in a sideway direction relative to the opening that it covers, and with a normally straight, linear motion. The edge of the door leaf, inside which the locking device is normally provided, thus makes contact with a striking arrangement in a door jamb or in the edge of another door leaf with a straight movement, directly towards the face of the striking arrangement. In order to allow locking of the door the locking element is therefore provided with a hook-shaped part, in order to enable engagement with the striking arrangement.

One problem with this and other locking devices is that if the closing element for some reason becomes loaded, for example by people leaning against the door in an emergency situation, the locking element may become pressed against a surface in the striking arrangement so that frictional forces blocks the locking element from moving. Hence it may become very difficult, or indeed impossible, to unlock the closing element. In electric locks, having locking elements moved by an electric motor, this problem has hitherto been addressed by providing an oversized and overly strong electric motor, in order to generate the high forces needed to overcome possibly increased friction. This in turn gives rise to problems with power supply, connectivity, and available space.

SUMMARY OF THE INVENTION

One objective of the present invention is to indicate a locking device which is simpler and/or less expensive to manufacture.

Another objective of the present invention is to indicate an improved locking device adapted to allow an automatic lock function.

Yet another objective of the present invention is to indicate a locking device allowing a safer and/or a more secure lock function.

According to one aspect of the invention one or more of these objectives are achieved with a locking device comprising a strike member arranged to strike the striking arrangement upon closing of the closing element, and to actuate a lock state control mechanism to move the locking element into an engaging position in response to the strike member hitting the striking arrangement. Hence, when closing the closing element the locking element is automatically moved towards its engaging position. Thus it is not necessary to include an electric motor specifically for moving the locking element. This in turn leads to that it is not necessary to include electric cables for a power supply to the locking device, making installation of the locking device simpler, and decreasing the risk for electric faults and fire. The mechanical lock state control mechanism further allows a faster and more efficient locking operation.

The locking device is preferably adapted to restrict access into an area or space in cooperation with at least one closing element arranged to cover an opening or entrance into said area or space. The locking device is preferably adapted to be installed in association with the closing element, more preferably inside a door leaf. Alternatively, however, the locking device may also be adapted to be installed inside an immovable object being close to the closing element and/or to the opening into the area or space, such as inside a door jamb.

A locking element may comprise a bolt, a bar, or any other rigid or solid member able to make a fixing connection between a movable closing element and an immovable object, such as a door jamb, or to another movable object, which is then likewise immobilised by the fixing connection, such as a second door in a door pair. Preferably the locking element is arranged to engage with a striking arrangement in order to make a fixing connection holding the closing element immobile. The locking element may then engage either the striking arrangement in order to hold the closing element closed. An important point is that the locking element may engage with the striking arrangement for holding the closing element closed both in a locked state, in which the closing element is fully locked and needs a key, key code or similar to open, and in an unlocked state, in which the closing element is closed but may be moved either due to an opening operation by a user or by the application of an opening force, a function which is similar to the function of a latch bolt.

In one embodiment the state controlling mechanism comprises a lever having a first lever arm connected with the strike member, and a second lever arm connected with the locking element, and which arms are pivotable around a common pivot point joining the first and the second lever arms. Preferably the lever is adapted to transfer motion between the strike member and the locking element in order to control the position of the strike element dependent on the state of the strike member. Hence an efficient mechanical connection and communication is achieved. The strike member is preferably projecting out from the locking device in order to hit the striking arrangement. Preferably the strike member is then pushed in inside the locking device by the striking arrangement when the closing element is closed. The strike member is then preferably arranged to actuate the lock state mechanism to extend the locking element into its engaging position when it is being pushed in.

In one embodiment the state controlling mechanism comprises a spring connected with and arranged to transfer forces between the first and the second lever arms. Hence the relative positions of the arms may change, giving a slack in the relative positions of, and in the motion between, the strike member and the locking element. Thus one of the strike member or the locking element may move while the other remains stationary. This gives the advantage that during opening or closing of the closing element the locking element may begin to retract before the strike member begins to be projected. This also gives the advantages of reduced tolerance demands allowing a simpler manufacturing, and also a more robust and reliable locking device. The stiffness of the spring affects the maximum force with which the strike member may push out the locking element via the lever, and also the force resisting a retraction of the locking element when opening the closing element, when the strike member is still under pressure from the striking arrangement.

In one embodiment the locking element comprises an engagement surface adapted to engage with the striking arrangement, which engagement surface is shaped to generate a force when the closing element is being opened, which force acts to move the locking element towards a non-engaging position. Preferably the locking element is then in an unlocked state. Hence the closing element may be opened automatically when the locking element is in an unlocked, but engaging, state by simply moving the closing element towards its open position. Due to that the force for moving the locking element originates from the movement of the closing element it is not necessary to arrange an electric motor inside the locking device for actuating the locking element, giving the same advantages as stated above.

Preferably, the engagement surface is also angled so as to decrease any frictional forces originating from a loading of the closing element. Hence there is less strain acting on the locking element so that it is simpler to move the locking element towards its non-engaging position and to open the closing element in case of loading of the closing element.

In one embodiment the locking device comprises a spring arranged to press the striking member towards a protruding position. Hence it is ensured that the striking member is in a protruding position when the closing element is open and the striking member is not in contact with the striking arrangement. The spring is preferably simultaneously also arranged to press the locking element towards its non-engaging state, preferably via the lock state control mechanism.

In one embodiment the locking device is shaped to be installed in association with at least one sliding door. The locking device according to the present invention is particularly suited for being associated with sliding doors, which otherwise have been difficult to provide with satisfactory locking devices. Preferably the locking element then comprises a hook-shaped part comprising an engagement surface for engagement with the striking arrangement facing back towards the locking device. Since sliding doors are opened by sliding in a direction parallel with the extension of the door, it is advantageous to provide an engagement surface facing towards the door for hindering the opening. Another advantage is that a closing element provided with the locking device may easily be opened in case of an emergency situation, so that it is no longer necessary to provide an additional emergency exit door as is currently the case.

According to one embodiment of the locking device the locking element is rotatable around a pivot point between a first, engaging position, and a second, non-engaging position. Hence the locking element may more easily move from its engaging position to its non-engaging position. In particular, the locking element may move more easily in case the closing element (or locking element) is loaded so that frictional forces are created which could hamper the movement. Also, in case of sliding doors, it is easier to provide a properly shaped and angled engagement surface.

In one embodiment the locking device comprises a blocking mechanism arranged to, in a first state, block the locking element from moving towards a non-engaging position, and to, in a second state, allow movement of the locking element towards the non-engaging position. Hence the blocking mechanism may control the locked or unlocked state of the locking element by blocking or allowing its movement from the engaging position to the non-engaging position. Thus the blocking mechanism may also determine the locked or unlocked state of the locking device as a whole. Preferably the present state of the blocking member is controlled by operation of a user, such as by use of a key, key code or similar.

The blocking mechanism further ensures that the locking device remains locked even if the locking element is subjected to a strong force in the direction of its non-engaging state. The blocking mechanism further ensures that the locking device remains locked even if the locking element is subjected to a rapid succession of sharp blows, a tampering attempt known as knocking. This in turn ensures that the inclusion of an engagement surface as stated above is not detrimental to the security of the locking device.

According to one embodiment the blocking mechanism comprises a blocking member arranged to block the locking element from moving towards its non-engaging position by being positioned and held immobile in the movement path of the locking element. The blocking member may also be positioned in a non-blocking position, in which the blocking member admits movement of the locking element towards its non-engaging position. Such a blocking member may easily be moved between its blocking and non-blocking position with but a low force, such as from a solenoid, while still being able to block high forces subjected to it by the locking element.

According to one embodiment an engagement part of the locking element adapted to engage the striking arrangement and a blocking part of the locking element adapted to be blocked by the blocking element are arranged on opposite sides of the pivot point. Hence the blocking member may be positioned close to the outer wall surface of the housing of the locking device, which is normally the most stable and durable wall surface. Thus the blocking mechanism will be more hardy, and more difficult to break.

According to another embodiment the blocking mechanism may instead be connected with and arranged to move the locking element, and may comprise a slot formed on one link and a sliding element formed on another link and arranged to slide along said slot, wherein the slot is angled so as to block motion of the sliding element, and thus of the links and of the locking element, when the locking device is locked and the locking element is pressed towards its non-engaging state.

According to another embodiment the strike member may be provided with a bevelled surface adapted to hit the striking arrangement. Hence the locking device is arranged to be suitable for use in association with a hinged door.

BRIEF DESCRIPTION OF THE ATTACHED DRAWINGS

The invention is now to be described as a number of non-limiting examples of the invention with reference to the attached drawings.

FIG. 1*a* shows a locking device according to one example of the invention in a locked state.

Figure 1B:
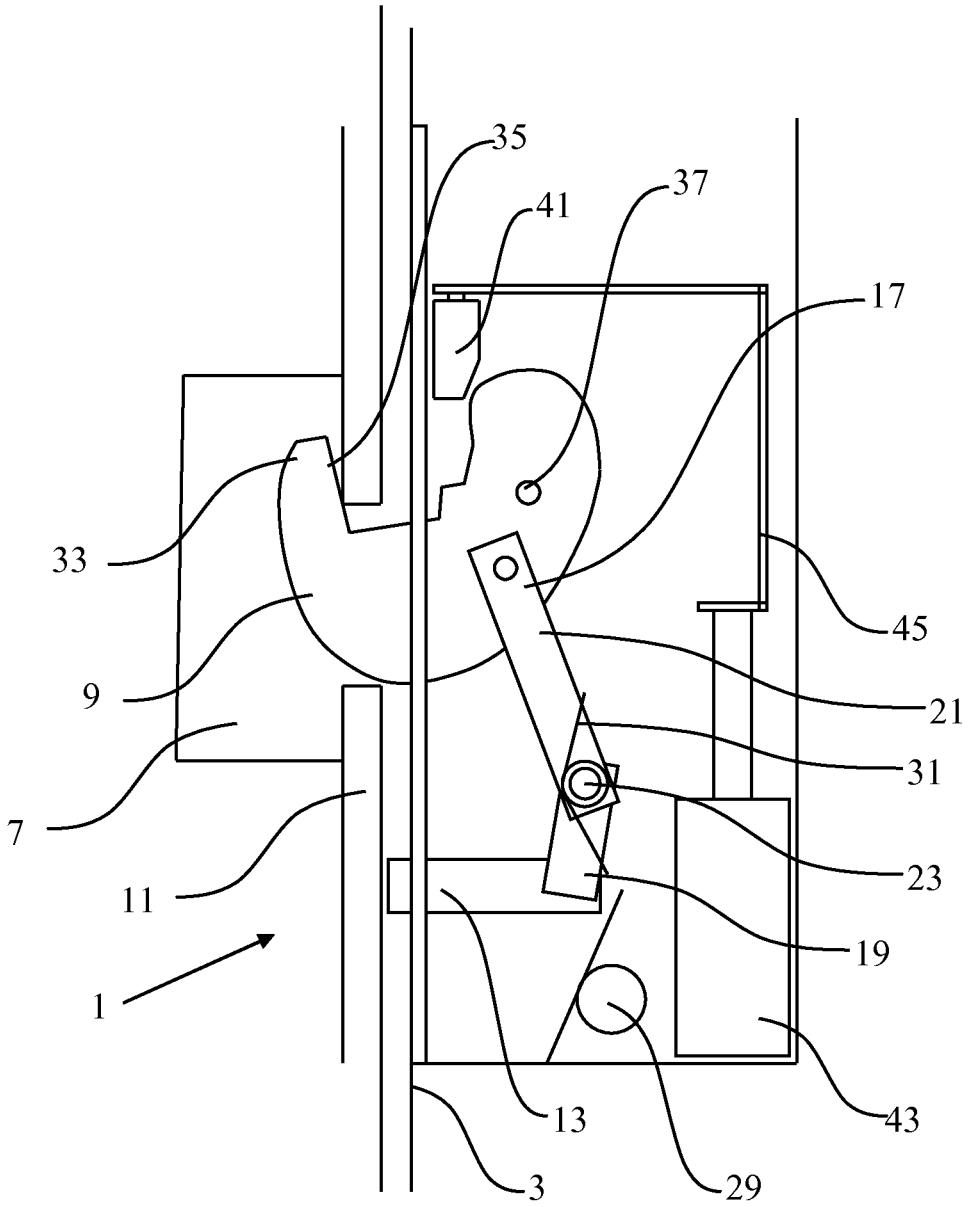

FIG. 1*b* shows the locking device in an unlocked, but still engaging, state on the verge of being opened.

Figure 1C:
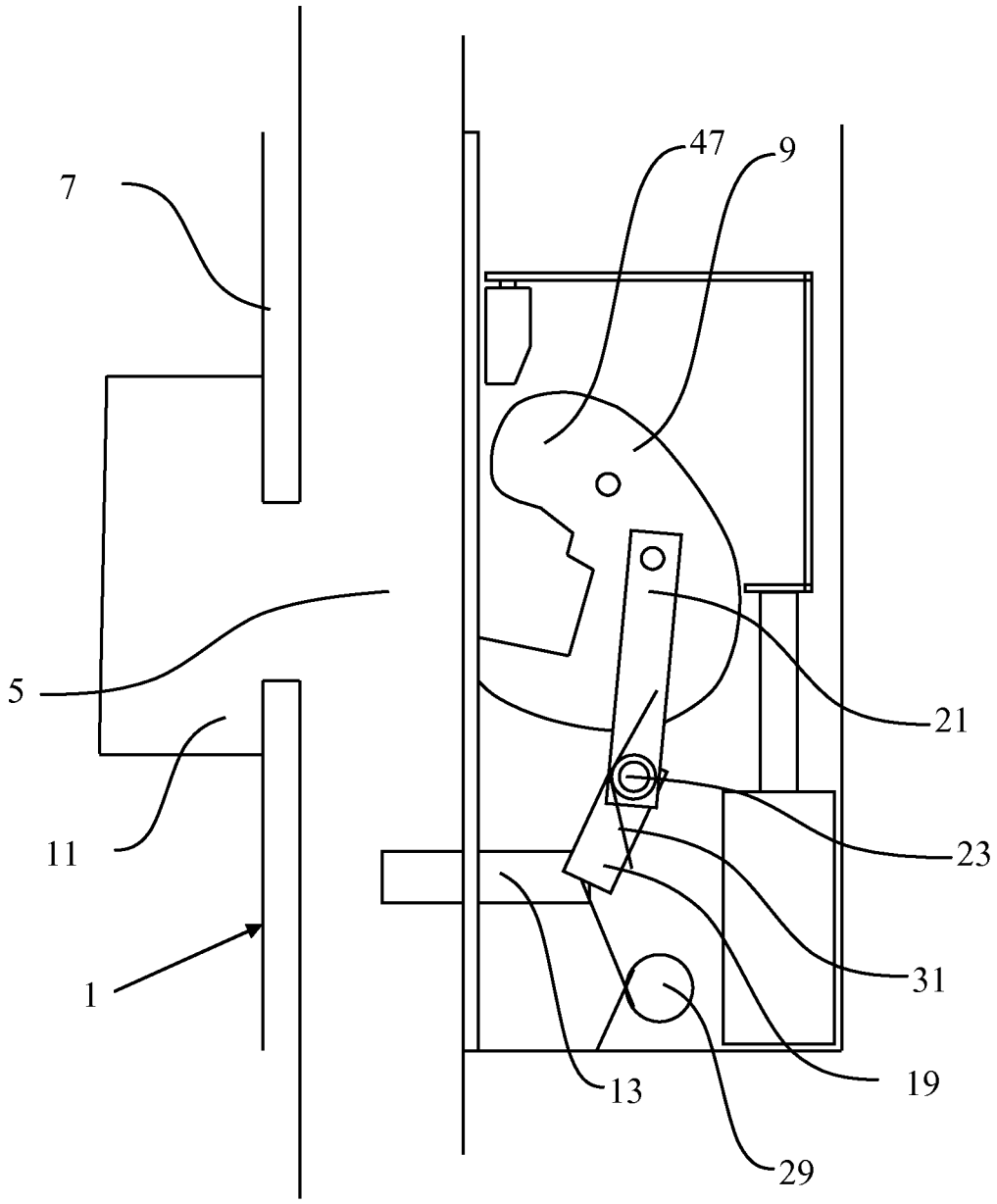

FIG. 1*c* shows the locking device in FIGS. 1*a-b* in an unlocked and non-engaging state, in which the closing element is fully opened.

DETAILED DESCRIPTION

In FIG. 1 *a-c* the same locking device 1 is shown in three different operational states. The locking device is arranged in association with a movable object, in this example with a closing element 3 in the form of a door, arranged to cover an opening 5 into an area or space in order to restrict access to the area or space. The closing element is arranged to make contact with an immovable object, in this example a door jamb 7 lining the opening its closed state, as shown in FIG. 1*a*. It should be appreciated that the locking device could be equally useful in other forms or configurations of openings, linings and closing elements.

The locking device comprises a locking element 9, which is solid and rigid in order to be able to make a fixing connection between the closing element and the door jamb. In this example the locking element is arranged to engage with a striking arrangement 11, in this example a strike plate, provided in the door jamb 7 in order to hold the closing element 3 closed in the closed position. The locking element 9 may thus be moved between an engaging position, shown in FIG. 1*a* and FIG. 1*b*, in which the locking element engages with the striking arrangement for holding the closing element in its closed position, and a non-engaging position, shown in FIG. 1*c*, in which the locking element avoids engagement with the striking element 11 so that the closing element may move freely. Furthermore, the locking device may hold the locking element 9 in a locked state in its engaging position, shown in FIG. 1*a*, in which the closing element is fully blocked from movement, and in an unlocked state in its engaging position, depicted in FIG. 1*b*, in which the closing element is allowed to move if an adequate opening force is applied.

The locking device further comprises a strike member 13 arranged to strike the striking arrangement upon closing of the closing element, and to actuate a lock state control mechanism 15 to move the locking element 9 into an engaging position in response to the strike member hitting the striking arrangement 11. Hence, when closing the closing element, that is, when going from the state in FIG. 1*c* towards the state in FIG. 1*a* via the state in FIG. 1*b*, the locking element 9 is automatically moved towards its engaging position. Thus it is not necessary to include an electric motor specifically for moving the locking element. This in turn leads to that it is not necessary to include electric cables for a power supply to the locking device, making installation of the locking device simpler, and decreasing the risk for electric faults and fire. The mechanical lock state control mechanism 15 further allows a faster and more efficient locking operation.

In this example the lock state control mechanism comprises a lever 17 having a first lever arm 19 connected with the strike member, and a second lever arm 21 connected with the locking element, and which arms are pivotable around a common pivot point 23 joining the first and the second lever arms. The lever thus provides a mechanical connection and communication between the strike member and the locking element, and is adapted to transfer motion between the strike member and the locking element in order to control the position of the strike element 9 dependent on the state of the strike member 13. In this example the first and the second arms are arranged on opposite sides of the common pivot point 23. Thus, when the first arm is pressed in one direction, the second arm is pressed in the opposite direction, and vice versa.

The locking device comprises a housing 25 enclosing the mechanism of the locking device, and which is further provided with a front plate 27 arranged to face the striking arrangement. The strike member 13 is movable between a first position in which the strike member is arranged to project out of the front plate 27 in order to be able to strike the striking arrangement (FIG. 1*c*), and a second position in which the strike member is mostly pushed in inside the locking device and is more or less flush with the surface of the front plate 27. The locking device further comprises a spring 29 arranged to bias the strike member towards its first, protruding position. During a closing operation the projecting strike member is pushed in from its first position towards its second position by the strike member hitting and making contact with the striking arrangement. The strike member then moves the first arm 19 backwards, leading to that the second arm 21 connected with the locking element is moved forwards and extends the locking element 9 from out of the locking device and into a hollow in the striking arrangement 11 for forming a fixed connection and engaging with the striking arrangement. During an opening operation the spring pushes the strike member towards its protruding position, moving the first arm 19 forwards and the second arm 21 backwards, and thus ensures that the locking element 9 is retracted towards its non-engaging position.

The state controlling mechanism 15 also comprises a spring 31 connected with and arranged to transfer forces and/or motion between the first 19 and the second 21 lever arms. Hence the relative positions of the arms may change, giving a slack in the relative positions of, and in the relative motions between, the arms and thus of the strike member and the locking element. During an opening or closing operation this allows that only one of the strike member or the locking element moves, while the other remains stationary, wherein the risk of the locking device becoming stuck due to the connection via the state controlling mechanism decreases. Otherwise, in the closed position, in which the strike member is forced into its second, pushed in, position, while the locking element is forced into its extended, engaging position, a stiff lever arm could lead to a deadlock between the locking element and the strike member.

The locking device is in this example shaped to be installed in association with a sliding door 3. A sliding door opens and closes in a sideway direction relative to the opening that it covers, and with a straight, linear motion. The front plate 27 of the locking device thus makes contact with the striking arrangement with a straight movement, directly towards the face of the striking arrangement. The locking element is provided with an engaging part 33, which in this example is hook-shaped, in order to enable a more secure engagement with the striking arrangement. The engaging part 33 is further provided with an engagement surface 35 facing towards the front plate 27 of the locking device, and thus towards the door 3, for stopping the door from opening.

The engagement surface 35 is further adapted to engage with the striking arrangement 11, and is shaped to generate a force when the closing element is being opened, which force acts to move the locking element 9 towards a non-engaging position. In this example the engagement surface 35 is angled slightly, so that when the engagement surface is pressed towards the edge of the striking arrangement, a force is generated which moves the locking element to move towards its non-engaging position. Thus the closing element may be opened automatically, at least when the locking element is in an unlocked, but engaging, state by simply moving the closing element towards its open position so that the engagement surface 35 is pressed towards the striking arrangement. The angle of the engagement surface also decreases any frictional forces originating from a loading of the closing element. Hence there is less strain acting on the locking element so that it is simpler to move the locking element towards its non-engaging position.

In this example the locking element is rotatable around a pivot point 37 between its first, engaging position, and a second, non-engaging position. Hence the locking element 9 may more easily move from its engaging position to its non-engaging position. In particular, this allows for easier movement of the locking element in case the locking element is under strain. In this example the engagement surface 35 is thus angled to generate a force which rotates the locking element to move towards its non-engaging position.

In order to allow locking of the locking element, the locking device comprises a blocking mechanism 39 arranged to, in a first state, block the locking element from moving towards its non-engaging position, and to, in a second state, allow movement of the locking element towards its non-engaging position. The blocking mechanism is preferably operator controlled, for example by a user of the lock, and actuable by the use of a key, key code, unlock signal or similar.

In this example the blocking mechanism 39 comprises a blocking member 41 arranged to block the locking element from moving towards its non-engaging position by being positioned and held immobile in the movement path of the locking element 9, as shown in FIG. 1*a*. In this example the blocking member 41 is connected with a solenoid 43 via a connecting arm 45, wherein the solenoid may move the blocking member between its blocking position and a non-blocking position in which the blocking member 41 is positioned elsewhere than in said movement path, in order to allow movement of the locking element towards its non-engaging position. In this example the blocking member 41 is moved upwardly in the figures, in order to enter its non-blocking position as shown in FIGS. 1*b* and 1*c*. The solenoid 43 is in turn controlled by an electronic control circuit (not shown) based on input signals generated by the user.

In this example the locking element further comprises a blocking part 47 of the locking element 9 adapted to be blocked by the blocking element 41. The engagement part 33 and the blocking part 47 of the locking element are arranged on opposite sides of the pivot point 37 of the locking member 9. Hence the engaging part and the blocking part will move in different directions when the locking element is rotated. The blocking part 47 is in this example arranged to move towards the inner surface of the front plate 27 when the locking element is rotated towards its non-engaging position in which the engagement part is retracted. The blocking member 41 is in this example arranged to be positionable in between the front plate and the blocking part of the locking member in its blocking state. The pivot point 37 of the locking element is then also provided at a location below the blocking member 41. Since the front plate of the housing 25 is normally thick and durable to withstand tampering attempts, the front plate provides a stable counter-stay for the blocking member. The blocking member is further arranged to bear against the inner surface of the front plate for support in its blocking position. Thus the function and reliability of the blocking member is improved.

The blocking mechanism 39 and the blocking member 41 ensures that the locking device remains locked even if the locking element is subjected to a strong force in the direction of its non-engaging state. The blocking mechanism further ensures that the locking device remains locked even if the locking element is subjected to a rapid succession of sharp blows, a tampering attempt known as knocking. This in turn ensures that the provision of an angled engagement surface as stated above is not detrimental to the security of the locking device.

In the following the operation of the locking device in conjunction with the closing element and the door jamb will be described in closer detail.

In a locked state, as shown in FIG. 1*a*, the blocking member 41 blocks the locking element 9 from rotating, so that if someone tries to open the door the locking element will remain in its engaging position and stop the door from moving.

In an opening operation and departing from FIG. 1*a*, a user first generates a signal to the solenoid 43 to retract the blocking member 41 into its non-blocking position. Then the closing element 3 is opened, either by the user or by remote means such as by an electric motor, by being moved towards the right in the figures. The engaging surface 35 of the locking element 9 engages the striking arrangement 11 and generates a force in response thereto that forces the locking element 9 towards its non-blocking position, as shown in FIG. 1*b*. Due to the provision of the spring 31 in the lever 17 of the lock state control mechanism 15, the arms of the lever may move relative each other, so that the locking element may retract even though the strike member 13 remains pushed in. After the locking element 9 has retracted sufficiently to no longer engage with the striking arrangement 11 the closing element is no longer in contact with the door jamb 7 and the striking arrangement, and may open freely. The spring 29 presses the strike member 13 to project out of the front plate 27, which in turn also affects the lever 17 to retract the locking element 9 in full, as shown in FIG. 1*c*. Hence the mechanism of the locking device is operated by self generated forces in interaction with the opening motion of the closing element.

In a closing operation and departing from FIG. 1*c*, the strike member 13 is in its projecting position and the door 3 is moved towards the door jamb 7 and the striking arrangement 11 until the strike member hits the striking arrangement. The strike member is then pushed in, which affects the lever 17 of the lock state control mechanism 15 to rotate the locking element 9, as depicted in FIG. 1*b*. When the door 3 is fully closed the strike member 13 is pushed in completely and the locking element 9 is extended into its engaging position and holds the closing element closed. The locking device is however still unlocked, and may thus easily be opened by applying an appropriate opening force on the closing element.

In a locking operation the user issues a control signal to the solenoid 43 to move the blocking member 41 into its blocking position, as shown in FIG. 1*a*. The locking element 9 is then unable to rotate, wherein the closing element is locked. Alternatively, the locking device may be adapted to be locked automatically upon closing, wherein the blocking member 41 is always moved into its blocking position by the solenoid 43.

The invention is not intended to be limited to the examples shown but may be varied freely within the framework of the following claims.

In particular the striking arrangement need not comprise a strike plate, but may simply be a surface arranged on a movable or immovable object cooperating with the locking device, and the locking device could be provided in association with a swinging door instead of a sliding door. The strike member could then be provided with a beveled surface in order to be pushed into the locking device more easily, and the locking element could similarly be provided with an engagement surface beveled in a sideway sense. The blocking mechanism need to comprise a blocking member, but could be provided by other means as described in this application or elsewhere.

The invention claimed is:

1. A locking device (1) suitable for allowing or restricting access into an area or space, the locking device (1) comprising at least one locking element (9) arranged to, in a first locking state, engage a striking arrangement (11) for holding a closing element (3) locked and, in a second non-locking state, allow movement of the closing element (3), wherein the locking device (1) comprises a strike member (13) continuously coupled with the locking element (9) via a lock state control mechanism (15) and arranged to strike the striking arrangement (11) upon closing of the closing element (3) and actuate the lock state control mechanism (15) to move the locking element (9) into an engaging position in response to hitting the striking arrangement (11), the locking element (9) is arranged to retract into housing (25) of the locking device (1) in the second non-locking state, the strike member (13) is arranged to extend out of the housing (25) in the second non-locking state and retract into the housing (25) and be substantially flush with a front plate (27) of the housing (25) in the first locking state, the lock state controlling mechanism (15) comprises a lever (17) having a first lever arm (19) directly connected with the strike member (13), and a second lever arm (21) directly connected with the locking element (9), and said lever arms (17, 19) are both mounted upon and pivotable around a common pivot point (23) joining the first and the second lever arms (17, 19).

2. A locking device (1) suitable for allowing or restricting access into an area or space, the locking device (1) comprising at least one locking element (9) arranged to, in a first locking state, engage a striking arrangement (11) for holding a closing element (3) locked and, in a second non-locking state, allow movement of the closing element (3), wherein the locking device (1) comprises a strike member (13) arranged to strike the striking arrangement (11) upon closing of the closing element (3) and actuate a lock state control mechanism (15) to move the locking element (9) into an engaging position in response to hitting the striking arrangement (11), the locking element (9) is arranged to retract into housing (25) of the locking device (1) in the second non-locking state, the strike member (13) is arranged to extend out of the housing (25) in the second non-locking state and retract into the housing (25) and be substantially flush with a front plate (27) of the housing (25) in the first locking state, the lock state controlling mechanism (15) comprises a lever (17) having a first lever arm (19) connected with the strike member (13), and a second lever arm (21) connected with the locking element (9), said lever arms (17, 19) being pivotable around a common pivot point (23) joining the first and the second lever arms (17, 19), and the lock state controlling mechanism (15) comprises a spring (31) connected with and arranged to transfer forces between the first (19) and the second (21) lever arms, such that during opening or closing movement, only one of the strike member (13) and locking element (9) move, while the other of the strike member (13) and locking element (9) remain stationary.

3. A locking device (1) according to claim 1, wherein the locking element (9) comprises an engagement surface (35) arranged to engage the striking arrangement (11), said engagement surface (35) being shaped to generate a force when the closing element (3) is opened, and acting to move the locking element (9) towards a non-engaging position.

4. A locking device (1) according to claim 1, comprising a spring (29) arranged to press the strike member (13) towards a protruding position.

5. A locking device (1) according to claim shaped to be installed in association with at least one sliding door as the closing element (3) and with the front plate (27) arranged to face the striking arrangement (11), wherein the locking element (9) comprises a hook-shaped part (33) having an engagement surface (35) arranged for engaging the striking arrangement (11), with said engagement surface (35) arranged to face towards the front plate (27) of the locking device (1).

6. A locking device (1) according to claim 1, wherein the locking element (9) is rotatable around a pivot point (37) between a first, engaging position, and a second, non-engaging position.

7. A locking device (1) according to claim 1, comprising a blocking mechanism (39) arranged to, in a first state, block the locking element (9) from moving towards a non-engaging position, and, in a second state, allow movement of the locking element (9) towards the non-engaging position.

8. A locking device (1) according to claim 7, wherein the blocking mechanism (39) comprises a blocking member (41) arranged to block the locking element (9) from moving towards its non-engaging position by being positioned and held immobile in the movement path of the locking element (9).

9. A locking device according to claim 8, wherein the locking element (9) is rotatable around a pivot point (37) between a first, engaging position, and the second, non-engaging position, an engagement part (33) of the locking element (9) is arranged to engage the striking arrangement (11), and a blocking part (47) of the locking element (9) is arranged to be blocked by the blocking element (41), with the engagement part (33) and the blocking part (47) arranged on opposite sides of the pivot point (37).

10. A locking device (1) according to claim 1, wherein the first and second lever arms (17, 19) are positioned underneath the locking element (9).

11. A locking device (1) suitable for allowing or restricting access into an area or space, the locking device (1) comprising at least one locking element (9) arranged to, in a first locking state, engage a striking arrangement (11) for holding a closing element (3) locked and, in a second non-locking state, allow movement of the closing element (3), wherein the locking device (1) comprises a strike member (13) continuously coupled with the locking element (9) via a lock state control mechanism (15) and arranged to strike the striking arrangement (11) upon closing of the closing element (3) and actuate the lock state control mechanism (15) to move the locking element (9) into an engaging position in response to hitting the striking arrangement (11), the locking element (9) is arranged to retract into housing (25) of the locking device (1) in the second non-locking state, the strike member (13) is arranged to extend out of the housing (25) in the second non-locking state and retract into the housing (25) and be substantially flush with a front plate (27) of the housing (25) in the first locking state, comprising a blocking mechanism (39) arranged to, in a first state, block the locking element (9) from moving towards a non-engaging position, and, in a second state, allow movement of the locking element (9) towards the non-engaging position, wherein the blocking mechanism (39) comprises a blocking member (41) arranged to block the locking element (9) from moving towards its non-engaging position by being positioned and held immobile in the movement path of the locking element (9), the locking element (9) is rotatable around a pivot point (37) between a first, engaging position, and the second, non-engaging position, an engagement part (33) of the locking element (9) is arranged to engage the striking arrangement (11), a blocking part (47) of the locking element (9) is arranged to be blocked by the blocking element (41), with the engagement part (33) and the blocking part (47) arranged on opposite sides of the pivot point (37), and the pivot point (37) is positioned below blocking member (41) and the first and second lever arms (17, 19) are positioned underneath the locking element (9).

12. A locking device (1) suitable for allowing or restricting access into an area or space, the locking device (1) comprising at least one locking element (9) arranged to, in a first locking state, engage a striking arrangement (11) for holding a closing element (3) locked and, in a second non-locking state, allow movement of the closing element (3), wherein the locking device (1) comprises a strike member (13) arranged to strike the striking arrangement (11) upon closing of the closing element (3) and actuate a lock state control mechanism (15) to move the locking element (9) into an engaging position in response to hitting the striking arrangement (11), the locking element (9) is arranged to retract into housing (25) of the locking device (1) in the second non-locking state, the strike member (13) is arranged to extend out of the housing (25) in the second non-locking state and retract into the housing (25) and be substantially flush with a front plate (27) of the housing (25) in the first locking state, additionally comprising a blocking mechanism (39) arranged to, in a first state, block the locking element (9) from moving towards a non-engaging position and, in a second state, allow movement of the locking element (9) towards the non-engaging position, the blocking mechanism (39) comprises a blocking member (41) arranged to block the locking element (9) from moving towards its non-engaging position by being positioned and held immobile in the movement path of the locking element (9), the locking element (9) is rotatable around a pivot point (37) between a first, engaging position, and the second, non-engaging position, an engagement part (33) of the locking element (9) is arranged to engage the striking arrangement (11), a blocking part (47) of the locking element (9) is arranged to be blocked by the blocking element (41), with the engagement part (33) and the blocking part (47) arranged on opposite sides of the pivot point (37), the blocking part (47) is substantially in the shape of a palette with an upwardly-facing indentation, and the blocking member (41) is arranged to extend downwardly into the indentation of the blocking part (47) in the first locking state and retract upwardly out of a recess in the second non-locking state.

13. A locking device (1) suitable for allowing or restricting access into an area or space, the locking device (1) comprising at least one locking element (9) arranged to, in a first locking state, engage a striking arrangement (11) for holding a closing element (3) locked and, in a second non-locking state, allow movement of the closing element (3), wherein the locking device (1) comprises a strike member (13) arranged to strike the striking arrangement (11) upon closing of the closing element (3) and actuate a lock state control mechanism (15) to move the locking element (9) into an engaging position in response to hitting the striking arrangement (11), the locking element (9) is arranged to retract into housing (25) of the locking device (1) in the second non-locking state, the strike member (13) is arranged to extend out of the housing (25) in the second non-locking state and retract into the housing (25) and be substantially flush with a front plate (27) of the housing (25) in the first locking state, the locking device (1) is shaped to be installed in association with at least one sliding door as the closing element (3) and with the front plate (27) arranged to face the striking arrangement (11), the locking element (9) comprises a hook-shaped part (33) having an engagement surface (35) arranged for engaging the striking arrangement (11), with said engagement surface (35) arranged to face towards the front plate (27) of the locking device (1), the hook-shaped engagement surface (35) is arranged to face upwardly and is rotatably mounted at a pivot point (37), and a blocking mechanism (39) comprises a blocking member (41) arranged to extend downwardly into the hook-shaped engagement surface (35) in the first locking state and retract upwardly out of the hook-shaped engagement surface (35) in the second non-locking state.

14. A locking device in accordance with claim 13, wherein the blocking mechanism (39) additionally comprises a solenoid (43) and an arm (45) connecting the solenoid (43) with the blocking member (41), with the solenoid (43) arranged to move the blocking member (41) out of the hook-shaped engagement surface (35) upon actuation by a user.

15. A locking device in accordance with claim 12, wherein the blocking mechanism (39) additionally comprises a solenoid (43) and an arm (45) connecting the solenoid (43) with the blocking member (41), with the solenoid (43) arranged to move the blocking member (41) out of the recess of the blocking part (47) upon actuation by a user.

16. A locking device in accordance with claim 5, wherein the engagement surface (35) faces towards the front plate (27) from outside the housing (25), with the striking arrangement (11) positioned between the engagement surface (35) and the front plate (27) in the first locking state.

* * * * *